US005294012A

United States Patent [19]

Shott et al.

[11] Patent Number: 5,294,012

[45] Date of Patent: Mar. 15, 1994

[54] TRASH RECEPTACLE MOUNTABLE ON A COLUMNAR SUPPORT

[76] Inventors: Vernon W. Shott; Tina L. Shott, both of P.O. Box 1755, Grants, N. Mex. 87020

[21] Appl. No.: 31,335

[22] Filed: Mar. 15, 1993

[51] Int. Cl.[5] ..... B65D 91/00

[52] U.S. Cl. ..... 220/23.4; 220/23.83; 220/909; 220/477

[58] Field of Search ..... 220/23.4, 23.83, 23.86, 220/908, 909, 477, 480, 481

[56] References Cited

U.S. PATENT DOCUMENTS

| | | | |
|---|---|---|---|
| D. 250,691 | 1/1979 | Horpestad | D7/189 |
| 447,221 | 2/1891 | Wiggers | 220/23.4 |
| 3,235,119 | 2/1966 | Smith | 220/908 |
| 3,696,938 | 10/1972 | Sherman | 211/78 |
| 3,788,720 | 1/1974 | Schneider | 312/211 |
| 4,708,256 | 11/1987 | Intardonato | 220/23.4 |
| 4,739,894 | 4/1988 | Pender | 220/23.4 |
| 4,827,645 | 5/1989 | Stamps, Jr. | 40/567 |
| 4,834,262 | 5/1989 | Reed | 220/909 |
| 5,018,876 | 5/1991 | Mennella | 220/909 |
| 5,050,755 | 9/1991 | Strawder | 220/23.4 |
| 5,050,762 | 9/1991 | Giorgi | 220/281 |
| 5,101,997 | 4/1992 | Bagwell et al. | 220/23.4 |

*Primary Examiner*—Joseph Man-Fu Moy
*Attorney, Agent, or Firm*—Robert A. Shack

[57] ABSTRACT

A trash receptacle particularly configured to be mounted on a column in an encircling fashion, and which includes a pair of outer baskets of generally half-cylindrical shape, an inner wall of each outer basket being provided with a recessed mounting channel dimensioned to accommodate the column. An inner basket is nested within each outer basket and is slidably retractable therefrom through the provision of handle grips formed thereon. A generally cylindrical periphery formed by the outer baskets has a number of display chambers spaced evenly thereabout for displaying visual media. A two piece conical hood is mounted on the column upward of the baskets, and provision is made for locking the inner baskets in place. Where the column is provided with a service connection adjacent a pedestal base, the mounting channels are preferably stepped in transverse dimension to accommodate same.

14 Claims, 3 Drawing Sheets

TRASH RECEPTACLE MOUNTABLE ON A COLUMNAR SUPPORT

BACKGROUND

1. Field of the Invention

The present invention relates to a trash receptacle for the deposition and containment of waste material therein. It is particularly configured for attachment to the columnar portion of a lighting standard, such as those regularly found in parking lots, malls, shopping centers, etc.

2. Description of the Related Art

The need for trash receptacles in such locations is clear. Additionally, the general public is becoming more conscientious about disposing of trash in a socially responsible manner, and proprietors and managers of such locations realize that providing for convenient trash disposal can result in tidier parking areas and lower maintenance costs. Placing trash containers in easily accessible locations, close by to parking lots or other heavily trafficked areas, encourages their use. Columnar supports, such as those used for lighting standards, are often found in such areas.

U.S. Pat. No. 3,788,720 relates to a rectangular frame around which the neck of a flexible refuse sack may be secured. The frame is attached to a vertical support. However, the apparatus disclosed in U.S. Pat. No. 3,788,720 is not particularly well suited for mounting on a lighting standard, such as those found in parking lots, where exposure to rain and/or snow should be taken into consideration.

U.S. Pat. No. 4,827,645 relates to a trash receptacle provided with back-lit advertising, but similarly fails to address the above considerations.

U.S. Pat. No. 5,050,762 relates to a free-standing garbage container having a cover which is permanently attached thereto by a flexible hinge.

U.S. Pat. No. 3,696,938 is directed to a support stand for providing access to a number of generally cylindrical garbage cans in a homeowner's garage, wherein the garbage cans are placed on a pair of vertically disposed turnstile arrangements.

U.S. Pat. No. Des. 250,691 is directed to a design for a free-standing garbage container.

SUMMARY OF THE INVENTION

In one aspect, the invention generally features a trash collection apparatus which includes a container having an inner wall upon which there is provided a recessed mounting channel, the transverse dimension of which varies along its length. The container also has an outer wall with at least one handle provided thereon. The trash collection apparatus also includes a container cover and at least one identification chamber attached to the container.

In another aspect, the invention generally features a trash receptacle for mounting on a column, which includes a pair of separate and discrete trash containers, each having a chamber for the deposit of trash therein, a recessed channel formed on an inner surface of each of the trash containers, and a clamping assembly for clamping the pair of trash containers together such that the column is located between the pair of trash containers and accommodated within each of the recessed channels.

In yet another aspect, the invention generally features a trash receptacle for the receipt and storage of trash, the trash receptacle being configured for mounting on a column, the column having a pedestal base and a service connection protruding radially from the column adjacent the pedestal base, the trash receptacle including a pair of outer baskets, each of the pair of outer baskets being of generally half-cylindrical shape and having a half-cylindrical outer wall, a generally flat inner wall and an upwardly facing opening; each inner wall of the outer baskets provided with a recessed mounting channel; each of the recessed mounting channels being of varying transverse dimension relative to the longitudinal axis thereof, and having a first portion with a first transverse dimension substantially equal to the transverse dimension of the column and a second portion with a transverse dimension at least as great as the transverse dimension of the column plus the radially protruding service connection; a pair of inner baskets, each of the inner baskets being dimensioned and configured to nest within one of the outer baskets, and each of the inner baskets also having a generally half-cylindrical outer wall, a generally flat inner wall and an upwardly facing opening; each of the inner baskets also being provided with a recessed channel dimensioned to nest with the recessed mounting channel provided on the corresponding outer basket; at least one handle grip formed on each of the inner baskets; at least a pair of placard chambers located on the outer walls of the outer baskets, the placard chambers being evenly spaced about a substantially circular periphery formed by the outer walls of the outer baskets; a clamping device for clamping the generally flat inner walls of the outer baskets together, the clamping device including at least one pair of bolt holes passing through both of the inner walls of the outer baskets, the recessed mounting channels being disposed between the bolt holes; a locking apparatus for locking the inner baskets in their nested positions within the outer baskets, the locking apparatus including a series of apertures, one each of the apertures being provided in each of the inner baskets and each of the outer baskets, and the series of apertures being substantially aligned when the inner baskets are nested within the outer baskets, and a padlock for passing through the series of substantially aligned apertures; and a hood, the hood including a pair of pitched semicircular hood members, a bracket attached to each of the hood members and a clamp for clamping the brackets and the attached hood members about the column.

Preferably, the recessed mounting channel is of stepped transverse dimension; each of the chambers has an upwardly facing opening; the trash receptacle further includes a hood and apparatus for mounting the hood on the column at a position above the upwardly facing opening; each of the trash containers includes an outer shell, one each of the recessed channels being formed on an inner surface of the outer shell, and an inner container, the inner container being configured to nest within the outer shell and to be slidably removable therefrom, and at least one handle provided on the inner container, for facilitating the removal of the inner container from the outer shell; the column includes a radially expanded pedestal and a radially protruding service connection adjacent the pedestal, each of the recessed channels includes a first portion dimensioned to accommodate the transverse dimension of the column and a second portion dimensioned to accommodate a greater transverse dimension of both the column and the service connection, and a bottom surface of each of the outer shells is configured to abut and be supported by the radially expanded pedestal; the trash receptacle additionally includes display apparatus for displaying visual media on an exterior surface of the trash receptacle; each of the trash containers has a substantially semicylindrical outer periphery, the semicylindrical peripheries defining a substantially cylindrical periphery when the pair of trash containers are clamped together by the clamping apparatus, and the display apparatus includes a plurality of display devices equally spaced about the substantially cylindrical periphery; each of the display devices includes a placard chamber; each of the placard chambers includes a frame member attached to the substantially cylindrical periphery, each of the frame members having a slot for the insertion and removal of a placard therefrom; the trash container further includes a locking apparatus for preventing the removal of the inner containers from the outer shells; the locking apparatus includes apertures passing through each of the outer shells and through each of the inner containers and a locking member positioned within the apertures.

One object of the present invention is the provision of a trash receptacle that is particularly adapted for mounting on a columnar support, such as a lighting standard commonly found in parking lots, in malls and in urban business areas.

Another object is the provision of such a trash receptacle that can be mounted on a column which includes a service connection, such as an electrical service connection.

A further object is the provision of such a trash receptacle that minimizes the possibility of theft of either the trash receptacle itself or its individual components.

The invention will now be described by way of a particularly preferred embodiment, reference being made to the accompanying drawings, wherein:

DESCRIPTION OF THE PREFERRED EMBODIMENT

Figure 1:
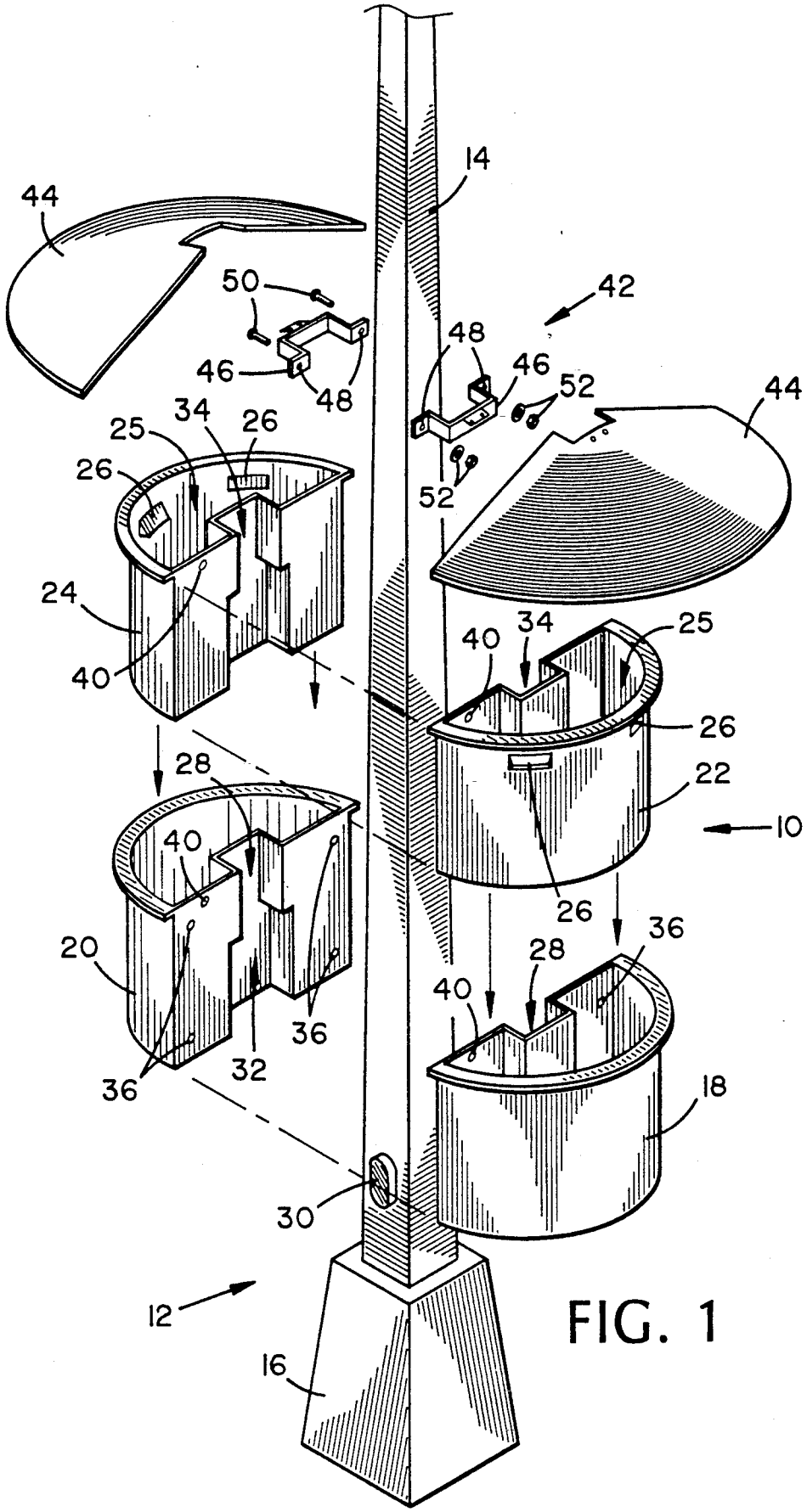
FIG. 1 is an exploded perspective view of a trash receptacle according to the invention.
Figure 3:
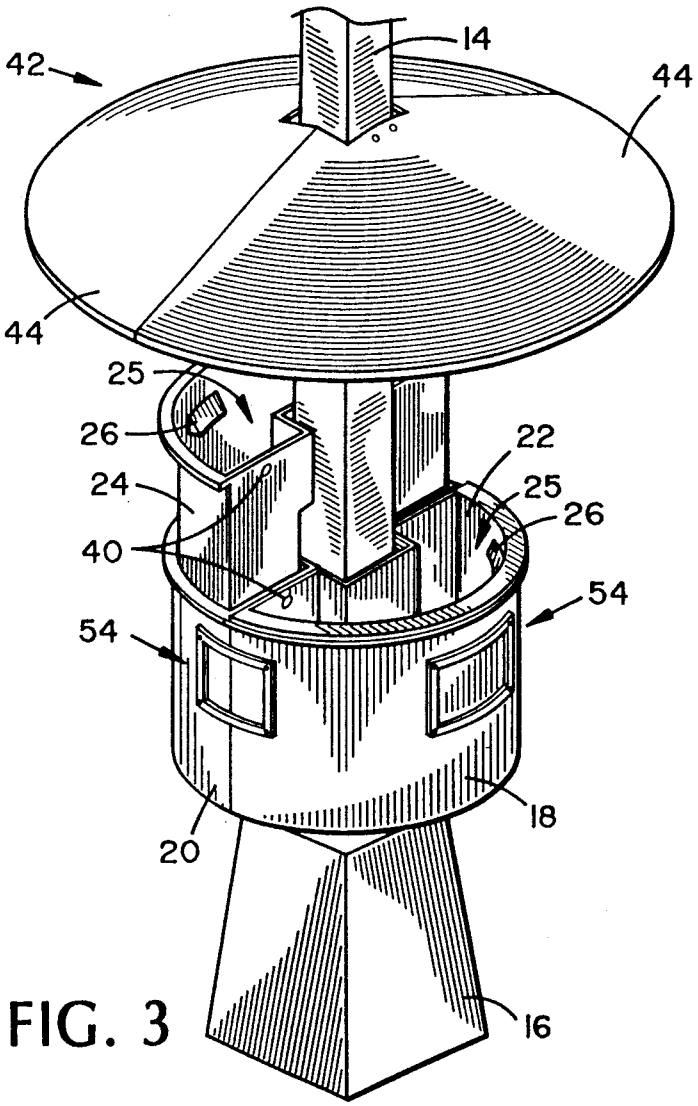
FIG. 3 is again a perspective view of the trash receptacle, here showing the removal of an inner trash container from a provided outer shell.
Figure 2:
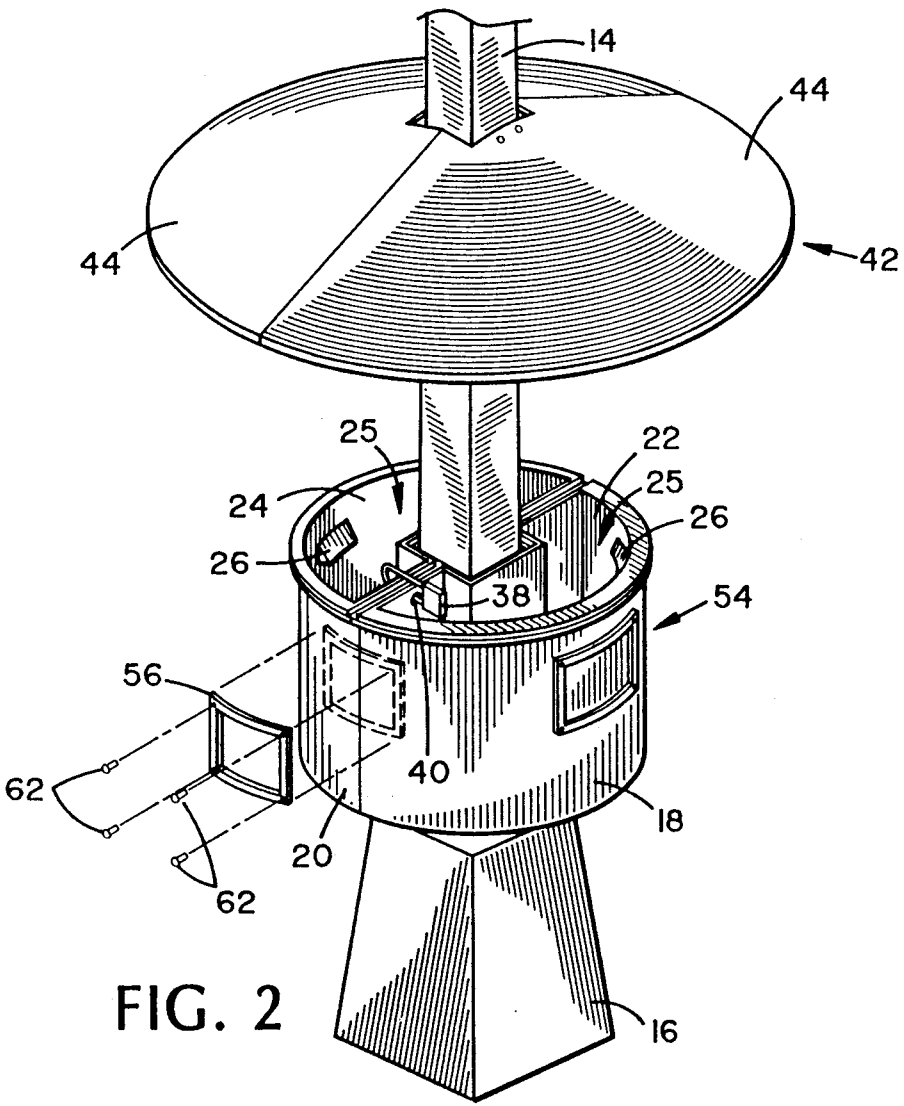
FIG. 2 is a perspective view of the trash receptacle mounted on the column of a lighting standard, with particular attention being paid to showing a locking device and a placard display.

Referring now to all of FIGS. 1–4, but most particularly to FIG. 1, a trash receptacle 10 is particularly designed for mounting on a light standard 12, which includes a generally vertical column 14 and a pedestal 16. The transverse dimensions of the pedestal 16 are generally greater than those of the column 14, thus, as shown in FIGS. 2 and 3, providing vertical support for the trash receptacle 10.

The trash receptacle 10 itself generally includes a pair of half-cylindrical shaped outer shells (or outer baskets) 18 and 20, each having a half-cylindrical outer wall and a generally flat inner wall. The trash receptacle 10 also includes a pair of generally similarly shaped inner containers (or inner baskets) 22 and 24, dimensioned so as to be slidably nestable within and therefore insertable and removable from the outer shells 18 and 20. The inner containers 22 and 24 have upwardly facing openings 25 for the receipt of trash. In order to facilitate their insertion and removal, the inner containers 22 and 24 are each provided with a pair of handles 26.

The inner walls of the outer shells 18 and 20 are each provided with a recessed channel 28 which is dimensioned to fit around and accommodate the column 14 of the light standard 12. Often such light standards are provided with an electrical service connection 30 which protrudes radially from the column 14 near the pedestal 16. In such case, each of the channels 28 is preferably provided with a portion 32 of enlarged cross-section dimensioned to fit over the service connection 30 when the outer shells 18 and 20 are resting on the pedestal 16.

As shown, the inner containers 22 and 24 are also preferably provided with corresponding recessed channels 34 on their inner walls, and in the case where a service connection 30 is present, the channels 34 are preferably also of varying cross-section and having an enlarged portion. Preferably, all of channels 28 and 34 have a stepped transverse dimension, as shown.

The trash receptacle 10 is secured to the column 14 by the provision of a clamping assembly which includes four bolt holes 36 in each of the outer shells 18 and 20, through which pass four bolts (not shown) that serve to fasten the outer shells 18 and 20 together such that they encircle the column 14 and prevent their removal therefrom.

Figure 4:
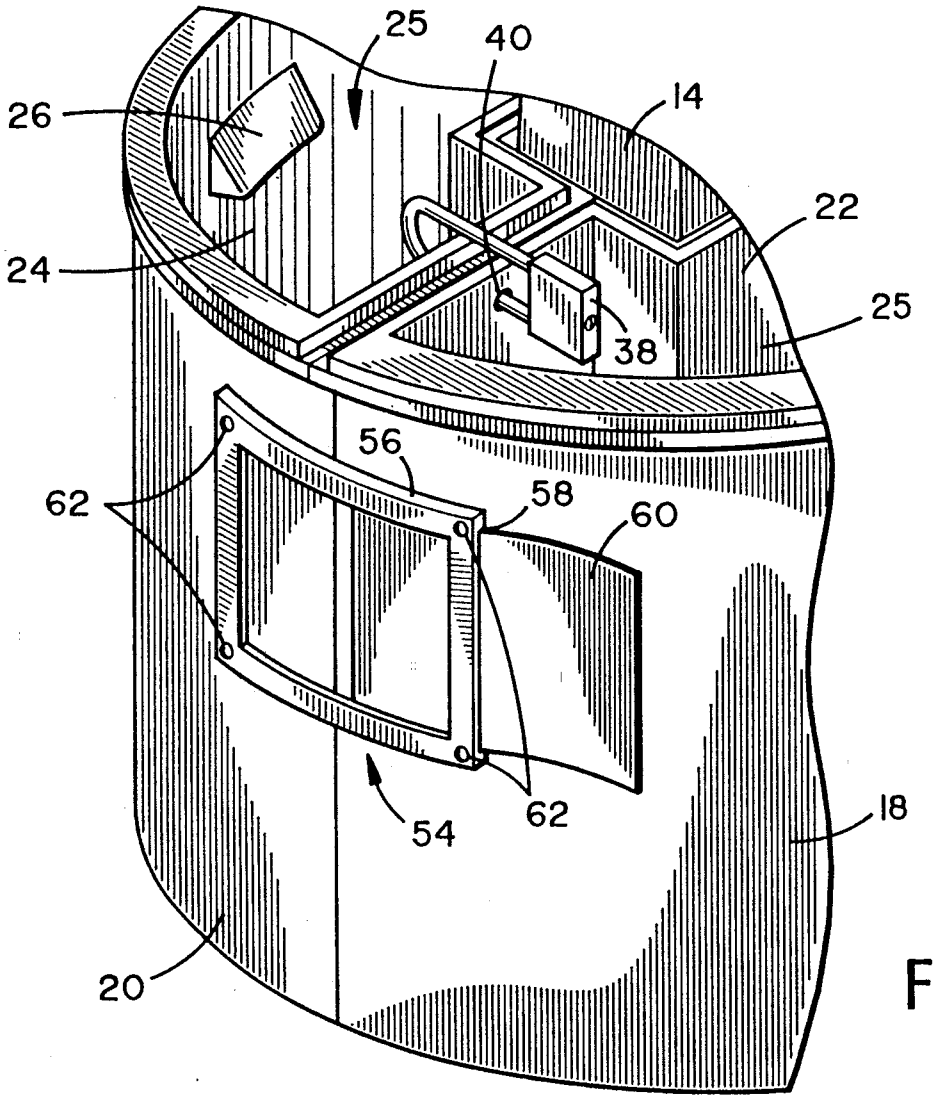
FIG. 4 is a cutaway perspective view, showing the locking device and the placard display in more detail.

Referring now most particularly to FIGS. 2 and 4, the inner containers 22 and 24 can also preferably be secured to prevent theft by the provision of a locking device (for example, a conventional padlock 38) which passes through a series of aligned apertures 40 provided in both the outer shells 18 and 20 and the inner containers 22 and 24.

As shown most clearly in FIG. 1, the trash receptacle 10 additionally preferably includes a hood 42. In the preferred embodiment shown, the hood 42 is an assembly of a pair of half hood members 44, each of which is in the form of a semiconical surface (or a pitched semicircle) and is attached, e.g., by spot welding or by bolts (not shown), to a bracket 46. The two brackets 46 mate with one another and are secured together by provided holes 48, bolts 50, and nuts (and associated washers) 52 so as to encircle the column 14.

Referring now most particularly to FIGS. 2 and 4, the trash receptacle 10 also includes at least one placard chamber 54, which is preferably a frame 56 having an open access slot 58 through which a placard (or other visual media) 60 may be inserted. The frame 56 is secured to an outer surface of the trash receptacle 10 by screws 62. As seen in FIGS. 2 and 3, a plurality of placard chambers 54 are preferably evenly spaced about the outer cylindrical surface of the trash receptacle 10. The placard chambers 54 may be positioned as shown in FIGS. 2–4 or may be offset from the positioning shown by a rotation of 45° in order to avoid having a placard chamber 54 cross the seam between the outer shells 18 and 20.

While the invention has been herein described by way of a particular preferred embodiment, various substitutions of equivalents may be effected without departing from the spirit and scope of the invention as set forth in the following claims.

What is claimed is:

1. A trash collection apparatus, comprising:

a container;

said container having at least one inner wall;

a recessed mounting channel provided on said inner wall of said container;

said recessed mounting channel having a transverse dimension which varies along the length of said recessed mounting channel;

said container also having at least one outer wall;

at least one handle provided on said outer wall of said container;

a container cover; and at least one placard chamber attached to said outer wall of said container; and wherein said placard chamber further comprises:

a frame member attached to said outer wall of said chamber; and a slot for the insertion and removal of a placard therefrom;

said placard being substantially visible in elevational view when disposed within said placard chamber.

2. A trash collection apparatus according to claim 1, wherein said recessed mounting channel is of stepped transverse dimension.

3. A trash receptacle for the receipt and storage of trash, said trash receptacle being configured for mounting on a column, the column having a pedestal base and a service connection protruding radially from the column adjacent the pedestal base, said trash receptacle comprising:

a pair of outer baskets, each of said pair of outer baskets being of generally half-cylindrical shape and having a half-cylindrical outer wall, a generally flat inner wall and an upwardly facing opening;

each inner wall of said outer baskets being provided with a recessed mounting channel;

each of said recessed mounting channels being of varying transverse dimension relative to the longitudinal axis thereof, and having a first portion with a first transverse dimension substantially equal to the transverse dimension of the column and a second portion with a transverse dimension at least as great as the transverse dimension of the column plus the radially protruding service connection;

a pair of inner baskets, each of said inner baskets being dimensioned and configured to nest within one of said outer baskets, and each of said inner baskets also having a generally half-cylindrical outer wall, a generally flat inner wall and an upwardly facing opening;

each of said inner baskets also being provided with a recessed channel dimensioned to nest with the recessed mounting channel provided on the corresponding outer basket;

at least one handle grip formed on each of said inner baskets;

at least a pair of placard chambers formed on said outer walls of said outer baskets, said placard chambers being evenly spaced about a substantially circular periphery formed by said outer walls of said outer baskets;

clamping means for clamping said generally flat inner walls of said outer baskets together, said clamping means comprising at least one pair of bolt holes passing through both of said inner walls of said outer baskets, said recessed mounting channels being disposed between said bolt holes;

locking means for locking said inner baskets in their nested positions within said outer baskets, said locking means comprising a series of apertures, one each of said apertures being provided in each of said inner baskets and each of said outer baskets, and said series of apertures being substantially aligned when said inner baskets are nested within said outer baskets, and a padlock for passing through said series of substantially aligned apertures; and a hood, said hood comprising a pair of pitched semicircular hood members, a bracket attached to each of said hood members and clamp means for clamping said brackets and said attached hood members about the column.

4. A trash receptacle for mounting on a column, comprising:

a pair of separate and discrete trash containers;

each of said trash containers having a chamber for the deposit of trash therein;

a recessed channel formed on an inner surface of each of said trash containers; and clamping means for clamping said pair of trash containers together, such that the column is disposed between said pair of trash containers and accommodated within each of said recessed channels;

each of said chambers has an upwardly facing opening; and wherein said trash receptacle further comprises:

a hood; and means for mounting said hood on the column at a position above said upwardly facing openings.

5. A trash receptacle according to claim 4, wherein each of said trash containers comprises:

an outer shell;

one each of said recessed channels being formed on an inner surface of said outer shell; and an inner container;

said inner container being configured to nest within said outer shell, and to be slidably removable therefrom; and at least one handle provided on said inner container for facilitating the removal of said inner container from said outer shell.

6. A trash receptacle according to claim 5, wherein the column incudes a radially expanded pedestal and a radially protruding service connection adjacent the pedestal, and wherein:

each of said recessed channels comprises a first portion dimensioned to accommodate the transverse dimension of the column, and a second portion dimensioned to accommodate a greater transverse dimension of both the column and the service connection; and a bottom surface of each of said outer shells is configured to abut and be supported by the radially expanded pedestal.

7. A trash receptacle according to claim 6, said trash receptacle additionally comprising display means for displaying visual media on an exterior surface of said trash receptacle.

8. A trash receptacle according to claim 7, wherein each of said trash containers has a substantially semicylindrical outer periphery, said semicylindrical peripheries defining a substantially cylindrical periphery when said pair of trash containers are clamped together by said clamping means, and wherein said display means comprises a plurality of display devices equally spaced about said substantially cylindrical periphery.

9. A trash receptacle according to claim 8, wherein each of said display devices comprises a placard chamber.

10. A trash container according to claim 9, wherein each of said placard chambers comprises a frame member attached to said substantially cylindrical periphery, each of said frame members having a slot for the insertion and removal of a placard therefrom.

11. A trash container according to claim 5, further comprising locking means for preventing the removal of said inner containers from said outer shells.

12. A trash container according to claim 11, wherein said locking means comprises:

an aperture passing through each of said outer shells and through each of said inner containers; and a locking member positioned within said aperture.

13. A trash container according to claim 10, further comprising locking means for preventing the removal of said inner containers from said outer shells.

14. A trash container according to claim 13, wherein said locking means comprises:

an aperture passing through each of said outer shells and through each of said inner containers; and a locking member positioned within said aperture.

* * * * *